US005808652A

United States Patent [19]

Iwao

[11] Patent Number: 5,808,652

[45] Date of Patent: Sep. 15, 1998

[54] IMAGE COMPOSING APPARATUS USING HEAT SUBLIMATION INKS

[75] Inventor: Naoto Iwao, Nagoya, Japan

[73] Assignee: Brother Kogyo Kabushiki Kaisha, Nagoya, Japan

[21] Appl. No.: 633,072

[22] Filed: Apr. 16, 1996

[30] Foreign Application Priority Data

May 11, 1995 [JP] Japan ..... 7-113029

[51] Int. Cl.[6] ..... B41J 2/325

[52] U.S. Cl. ..... 347/171

[58] Field of Search ..... 347/171, 188, 347/198; 400/120.01, 120.09, 120.13; 500/227

[56] References Cited

U.S. PATENT DOCUMENTS 4,558,329 12/1985 Honda ..... 347/176
5,006,502 4/1991 Fujimura et al. .
5,467,120 11/1995 Sadaki et al. ..... 347/171
5,631,688 5/1997 Hibino et al. ..... 347/171
5,640,180 6/1997 Hale et al. ..... 347/3

FOREIGN PATENT DOCUMENTS 61-51356 3/1986 Japan .
63-35387 2/1988 Japan .

*Primary Examiner*—Adolf Berhane
*Attorney, Agent, or Firm*—Oliff & Berridge, PLC

[57] ABSTRACT

The image composing apparatus of the invention includes an ink medium, a halogen heater for preparatorily heating the ink medium, and a thermal head which heats the ink medium and transfers the heat sublimation ink onto the recording medium. The ink medium has an ink carrier made from a resin on which a heat sublimation ink is dispersed and which is formed on the outer perimeter of a cylindrical axle on which a heat resistant resin layer of polyimid, or similar material, is formed on the surface. The ink maintaining unit temporarily maintains the heat sublimation ink which has sublimed by a preparatory heating using from the halogen heater established inside the axle to move from the ink carrier to the surface layer.

20 Claims, 4 Drawing Sheets

IMAGE COMPOSING APPARATUS USING HEAT SUBLIMATION INKS

BACKGROUND OF INVENTION

1. Field of Invention

The invention relates to an image composing apparatus, and more specifically, an image composing apparatus with sublimation type heat copying method, also known as a dye diffusion and thermal transfer method, which uses a heat sublimation ink.

2. Description of Related Art

In the prior art, an image composing apparatus with a heat copying method is comprised of a non-copying medium 430, an ink medium 420 and a thermal head 410, as shown in FIG. 4. The thermal head 410 has a head 411 including an electrical resistant heat generator that generates heat from an electrical current, and a power source 412 that controls the heat generation of the head 411 in response to an image signal which is supplied from a control circuit (not shown). The ink medium 420 comprises a base film 421 and an ink layer 422 on which the sublimation dyes are dispersed. The recording medium 430 includes the paper 431 and the platen 432 which is arranged on the side opposite the head 411 with respect to the paper 431. In response to the image signal sent from the control circuit, the head 411 generates heat as a result of the driving signal from the driving power source 412. As a result, the ink in the ink layer 422 of the ink medium 420 sublimes and transfers to the receiving image layer of the paper 431 to produce an image, corresponding to the image signal, on the paper 431.

Image composing apparatuses of the type just discussed are disclosed in Japanese Patent Publications Nos. 61-51356 and 63-35387. U.S. Pat. No. 5,006,502 discloses an ink transfer sheet or ribbon for use with the printing devices.

However, in the image composing apparatus using the heat copying method as described, the image is composed by sublimation copying of the ink layer from the base film to the recording medium by the application of heat to the ink medium. Because of this, in the section of the ink layer which does not contribute to image composition, the ink remains on the base film in its original state and in the section of ink layer which contributes to image composition, almost none of the ink remains. Because of this, when the ink medium is once used for image composition, it cannot be used again. The ink medium is discarded after the one use. Because of this, a great amount of ink is wasted resulting in high operating costs.

SUMMARY OF INVENTION

The object of the invention is to resolve the problem by furnishing an image composing apparatus provided with an ink supply means that can use all of the ink of the ink medium without waste.

In order to attain this object, the image composing apparatus of the invention comprises an ink medium which is made from an ink carrier carrying heat sublimation ink and an ink medium maintaining unit to laminate the ink carrier and maintain the heat sublimation ink being sublimed by preparatory heating, a preparatory heating means which does preparatory heating of the ink carrier, and a heat recording means to record the heat sublimation ink, maintained in the ink maintaining unit, by heating and sublimating onto the recording member.

The ink carrier can also be structured to be attachable and removable from the ink medium. The ink medium is desirably a rotating body. Moreover, the ink carrier may be made of resin materials in which the heat sublimation ink is dispersed and the ink maintaining unit may be formed from porous materials. When the ink maintaining unit is porous, it is desirable for the holes of the porous materials, which form said ink maintaining unit, to extend radially, that is, in the direction of the diameter of the ink medium.

An image composing apparatus of the invention which has the described structure causes sublimation of the heat sublimation ink from the ink carrier by the operation of the preparatory heating means, which is maintained in the ink maintaining unit. Also, during the recording time, by operating the heating recording means, the heat sublimation ink which is preserved at the ink maintaining unit is heated, sublimed, and copied onto the recording paper.

If the ink carrier is structured to be attachable and removable from the ink medium then, when the ink runs out, the ink carrier can be removed from the ink medium and replaced by a new ink carrier or the ink can be replenished. Also, if the ink medium is a rotating body, the ink present in the ink medium can be used uniformly.

Moreover, if the ink carrier is made from resin materials in which the heat sublimation ink is dispersed, a process that carries the ink uniformly on the ink carrier becomes unnecessary.

Also, if the ink maintaining unit is made from porous materials and, further, if the holes of the porous materials which form this ink maintaining unit are structured to extend radially in the diameter direction of the ink medium, not only does ink maintenance become easy, the preserved ink can be used and scattered on the recording medium without waste.

It is clear from the above explanation that in the image composing apparatus of the invention, the only ink consumed is during image composition. Also, because the ink is continuously supplied to the image composition position, the ink can be used without waste and the operating costs associated with image composition can be minimized.

Because the ink medium undergoes a preparatory heating, and is temporarily maintained at the maintenance unit, copying and recording can be done using small heat energy. As a result, the recording operation can be completed quicker.

BRIEF DESCRIPTION OF THE DRAWINGS

A preferred embodiment of the invention will be described in detail with reference to the following figures, in which.

DETAILED DESCRIPTION OF THE PREFERRED EMBODIMENT

Figure 1:
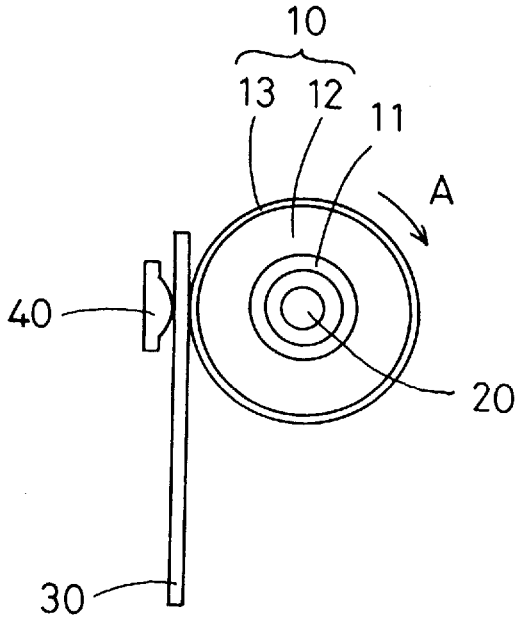
FIG. 1 shows a schematic diagram of an image composing apparatus of the embodiment.

Hereafter an embodiment of the invention will be explained with reference to the drawings.

First, a structure of the image composing apparatus of the first embodiment will be explained using FIG. 1. The image composing apparatus 1 comprises an ink medium 10, a halogen heater 20 which preparatorily heats the ink medium 10 from the inside, and a thermal head 40 which prints to the recording medium 30 by heating, from outside of the ink medium 10, to sublimate the heat sublimation ink which is carried in the ink medium 10.

The ink medium 10 is mounted with a cylindrical axle 11 to rotate in the direction of arrow A in FIG. 1, with a predetermined velocity, and is connected to a rotation driving means (not shown). On the surface of the axle 11 is formed at least, a heat resistant resin layer, such as polyimid. Also, placed inside the axle 11 is a halogen heater 20.

The ink medium 10 comprises an ink carrier 12 and an ink maintaining unit 13. The ink carrier 12 has a cylindrical structure and the heat sublimation ink is dispersed on resin materials, such as polyvinylbutyral, acrylonitrilestyrene, polyvinyl alcohol, hydroxylmethyl and cellulose, and is maintained on the outer periphery of axle 11. The ink maintaining unit 13 is structured to laminate the outer periphery of the ink carrier 12 and is made from polycarbonate porous materials which have holes oriented or aligned in the direction of thickness. Preparatory heating is provided to the heat sublimation ink by preparatory heating using the halogen heater 20.

Other materials which can be used as the ink maintaining unit 13, than the polycarbonate porous materials, are materials such as polytetrafluoroethylene, and porous rubber materials such as SBR. If the holes of ink maintaining unit 13 are oriented to extend radially from the ink carrier 12, the flow of sublimated ink is regulated in the direction of the recording medium 30 from the ink carrier 12. As a result, the resolution ability of the recording image is increased.

Figure 2:
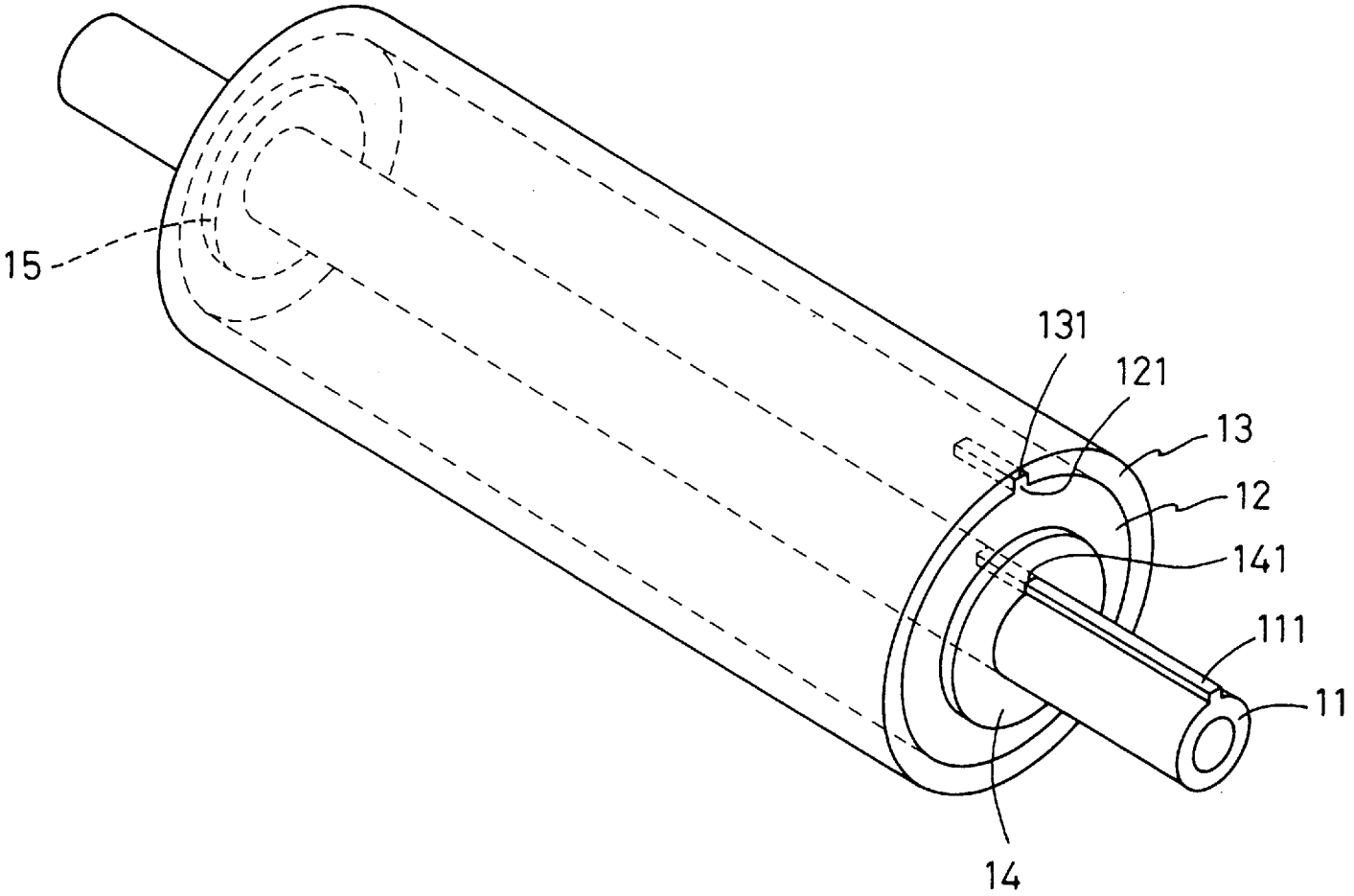
FIG. 2 shows the structure of the ink medium mounted to the image composing apparatus of the first embodiment.

In the ink medium 10 thus structured, the axle 11 and the ink carrier 12 are engaged to each other by means of a key 111 and a key groove 141, provided to axle 11 and ink carrier 12 respectively as shown in FIG. 2. The ink carrier 12 and the ink maintaining unit 13 are engaged to one another by key 121 and a key groove 131 which are provided in the ink carrier 12 and ink maintaining unit 13. Thus, relative movement in the rotating direction is restricted. Also, threaded washer 15, which is screwed onto axle 11, or other device that can be similarly fixed in position, and flange 14, which is made as one unit with axle 11, prevent the ink carrier 12 and the ink maintaining unit 13 from moving in the axle direction of axle 11. Other removable fixing means could be used to hold the ink carrier 12 and the ink maintaining unit 13 against the flange 14, such as a cotter pin or a snap washer. Because of this, when the ink dispersed in the ink carrier 12 runs out, the ink carrier 12 can be replaced by removing washer 15, or other removable retention device, and pulling the ink carrier 12 from the axle 11.

The thermal head 40 has an electric resistant heat generator internally housed therein which emits heat by means of the application of electric signals which correspond to image signals output from a driving control circuit (not shown).

Next, the operation of the image composing apparatus, which is structured in the manner described above, will be explained with reference to FIG. 1. First, the ink carrier 12 is preparatorily heated by the halogen heater 20. The halogen heater 20 is turned on when the image composing apparatus is turned on and remains on so long as the apparatus is on. Alternatively, a detector or counter may be provided to count the number of characters printed and the halogen heater 20 turned on for a predetermined period after a predetermined number of characters have been printed.

The dispersed heat sublimation ink, which is dispersed in the ink carrier 12, sublimes to a gaseous state, and is temporarily dispersed and maintained in the ink maintaining unit 13 where it sublimates back to the solid state. Then, the thermal head 40 generates heat corresponding to an image signal and, because of the heat, the ink which is dispersed and maintained in ink maintaining unit 13 is further heated and sublimes to the gaseous state. At that time, sublimation printing is done on the recording medium 30, such as a piece of paper. The image corresponding the image signal is thus formed on the recording medium.

Only the part of the ink, corresponding to the image signal, which was dispersed in ink maintaining unit 13 is used for image composition. However, even while the ink medium 10 rotates in the direction of arrow A, the heat sublimation ink is supplied to the ink maintaining unit 13 from the ink carrier 12 due to the heat emitted from the halogen heater 20. Because of that, the section of the ink maintenance unit 13 which is used for image composition and where ink is sublimed completely, the heat sublimation ink is always supplied from ink carrier 12. This results in ink maintaining unit 13, which is conveyed to the image composition position in the vicinity of thermal head 40, to maintain the state in which heat sublimation ink is dispersed and maintained for use.

Also, when the ink which was dispersed in the ink carrier 12 runs out, the washer 15 is removed, and only the ink carrier 12 need be removed from the ink medium 10 and discarded.

Figure 3:
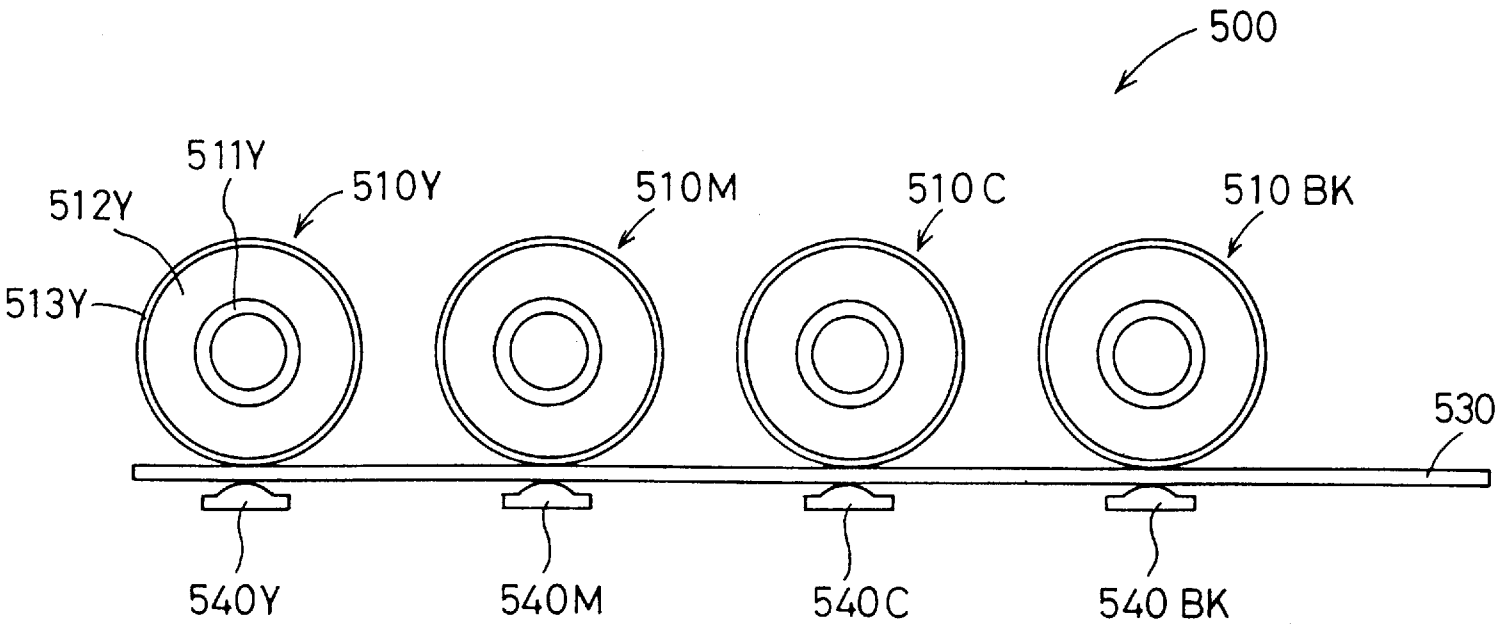
FIG. 3 is a schematic of another embodiment.
Figure 4:
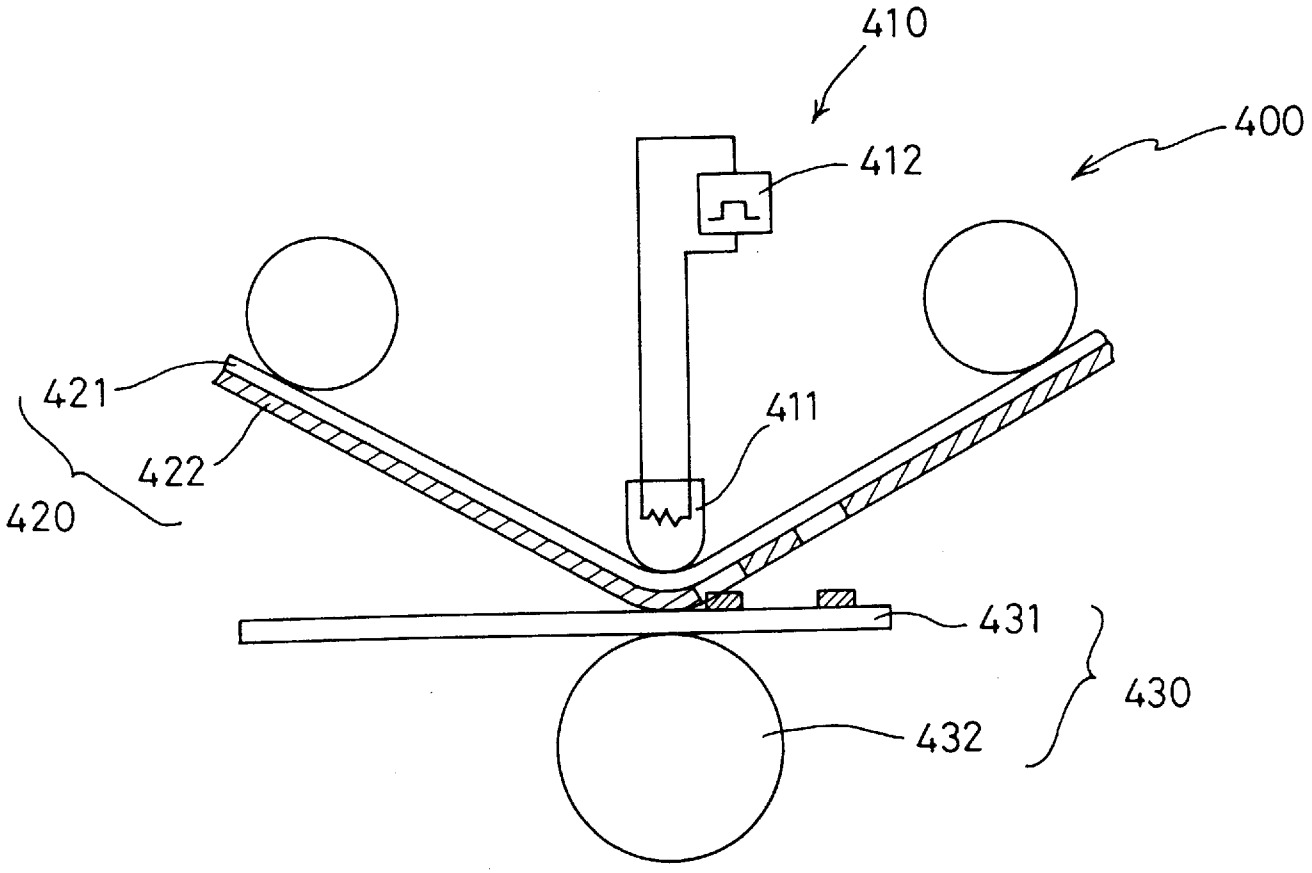
Fig.4 PRIOR ART
FIG. 4 shows a prior art sublimation type heat copying image composing apparatus.

Next, the color image composing apparatus 500 to which the image composition apparatus of the invention is applied will be explained with reference to FIG. 3.

The color image composing apparatus 500 comprises a yellow ink medium 510Y carrying yellow ink, a magenta ink medium 510M which composes magenta images, a cyan ink medium 510C which composes cyan images, and a black ink medium 510BK which composes black images and the thermal heads 540Y, 540M, 540C, and 540BK which heat and record the ink mediums 510Y, 510M, 510C, 510BK of each color according to provided image signals.

The operation of color image composing apparatus 500, structured in the manner described above, will be explained but in relation to each color image composing method. Because each color image composing medium is the same as the image composing apparatus of the embodiment previously explained in detail, a detailed explanation of the apparatus will not be repeated.

First, the yellow ink image is composed by thermal head 540Y and yellow ink medium 510Y is sublimated onto recording medium 530. Next, the magenta ink image is overlaid onto the yellow ink image on the recording medium 530 when it is conveyed to the position of magenta ink medium 510M. Next, the ink image, made by overlaying the ink images of the two previous colors, is conveyed to the position of the cyan ink medium 510C, and than cyan ink image is overlaid. Lastly, the three color ink image is conveyed to the position of the black ink medium 510BK and where the black image is overlaid onto the image made by overlaying the ink image of the previous three colors. The result is a full color image that is composed on the recording medium 530.

As described, the ink image is composed in the ink image order of yellow, magenta, cyan, and black, but this order may be changed to any order. Also, it is possible to create a color image without using black ink, rather by using the three colors of yellow, magenta, and cyan.

Moreover, in the embodiment, a halogen heater is used as the preparatory heating means, but it is possible to use other heat generating members, such as infrared heaters. Also, a heater having a sheet form may be attached to the axle.

Further, the resin materials used for the ink carrier or the ink maintaining unit are not limited to the materials listed in the embodiment. The efficacy of the invention will not be lost if other materials are used as long as the materials can disperse and maintain heat sublimation ink. In addition, a variety of modifications are possible without deviating from the intention of the invention.

What is claimed is:

1. An image composing apparatus for printing on a recording medium, comprising:

an ink carrier which contains heat sublimation ink;

preparatory heating means for preparatory heating of the ink carrier;

ink maintaining means for receiving and holding the heat sublimation ink which sublimes from said ink carrier with the preparatory heating, and is mounted to said ink carrier; and heating recording means for using the heat sublimation ink maintained in said ink maintaining means by heating and sublimation to print on the recording medium.

2. The image composing apparatus of claim 1, wherein said ink carrier is attachable and detachable from the ink maintaining means.

3. The image composing apparatus of claim 1, wherein the ink maintaining unit and the ink carrier are made of a rotating body.

4. The image composing apparatus of claim 1, wherein the ink carrier is formed of a resin material in which the heat sublimation ink is dispersed.

5. The image composing apparatus of claim 1, wherein the ink maintaining means is made of a porous material.

6. The image composing apparatus of claim 5, wherein the holes of the porous material which makes up said ink maintaining means extends radially of the ink medium.

7. A printing apparatus using sublimation ink having a printing element for printing on a recording medium, the printing element comprising:

a first heating element;

an ink providing layer adjacent the first heating element;

an ink printing layer overlying the ink providing layer on a side of the ink providing layer opposite the first heating element;

a print heating element opposing the ink printing layer with the recording medium passing therebetween; and a sublimation ink stored in the ink providing layer.

8. The printing apparatus of claim 7, further comprising a cylindrical body, the first heating element mounted in the cylindrical body and the ink providing layer and the ink printing layer successively mounted to the cylindrical body.

9. The printing apparatus of claim 7, wherein there are a plurality of printing elements, each printing element having an ink of a different color.

10. The printing apparatus of claim 8, wherein the cylindrical body is rotatable and the ink providing layer and the ink printing layer are fixed to the cylindrical body so as to rotate therewith.

11. The printing apparatus of claim 8, wherein the ink providing layer and the ink printing layer are removably mounted to the cylindrical body.

12. The printing apparatus of claim 10, wherein the ink providing layer and the ink printing layer are removably mounted to the cylindrical body.

13. The printing apparatus of claim 7, wherein the ink printing layer is made of a porous material.

14. The printing apparatus of claim 13, wherein pores of the porous material of the ink printing layer are oriented to extend from the ink providing layer toward the print heating element.

15. The printing apparatus of claim 8, wherein the ink printing layer is made of a porous material.

16. The printing apparatus of claim 15, wherein pores of the porous material of the ink printing layer are oriented radially of the cylindrical body.

17. The printing apparatus of claim 7, further comprising a cylindrical body, the first heating element mounted to an outer surface of the cylindrical body and the ink providing layer overlying the first heating element.

18. An ink sublimation printing element for a printer for printing on a recording medium, comprising:

a first heat source;

an ink storage layer mounted to the first heat source for storing sublimation ink;

an ink printing layer overlaying the ink storage layer; and a print heat source opposing the ink printing layer through the recording medium passing therebetween, wherein heat from the first heat source causes the sublimation ink to sublime from the ink storage layer to the ink printing layer.

19. The ink sublimation printing element of claim 18, further comprising a rotatable cylindrical body housing the first heat source, the ink storage layer and ink providing layer removably mounted to the cylindrical body.

20. The ink sublimation printing element of claim 19, further comprising means for rotationally fixing the ink storage layer and the ink printing layer when mounted to the cylindrical body so as to rotate therewith.

* * * * *